United States Patent [19]

Nakayoshi et al.

[11] Patent Number: 4,971,525

[45] Date of Patent: Nov. 20, 1990

[54] HYDRAULIC PUMP FOR HYDRAULICALLY DRIVEN FAN SYSTEM

[75] Inventors: Hideki Nakayoshi, Kariya; Yoshinari Takakura, Anjo, both of Japan

[73] Assignee: Aisin Seiki Kabushiki Kaisha, Kariya, Japan

[21] Appl. No.: 400,709

[22] Filed: Aug. 30, 1989

[30] Foreign Application Priority Data

Aug. 30, 1988 [JP] Japan ..... 63-215476

[51] Int. Cl.[5] ..... F01P 7/02

[52] U.S. Cl. ..... 417/201; 417/292; 123/41.12

[58] Field of Search ..... 123/41.12, 41.49; 417/292, 201, 13

[56] References Cited

U.S. PATENT DOCUMENTS

| | | | |
|---|---|---|---|
| 2,192,442 | 3/1940 | Hoffman | 417/201 |
| 3,722,329 | 3/1973 | Van Hecke et al. | 418/166 X |
| 3,824,047 | 7/1974 | McDermott | 418/171 |
| 3,834,842 | 9/1974 | Dorff et al. | 418/171 X |
| 4,361,419 | 11/1982 | Vohringer | 418/171 X |
| 4,461,246 | 7/1984 | Clemente | 123/41.12 |
| 4,738,330 | 4/1988 | Suzuki et al. | 123/41.12 |
| 4,789,177 | 1/1989 | Oomura et al. | 123/41.12 |

FOREIGN PATENT DOCUMENTS

| | | | |
|---|---|---|---|
| 541772 | 8/1959 | France | 123/41.12 |
| 113191 | 5/1988 | Japan | 418/166 |
| 2002453 | 2/1979 | United Kingdom | 418/166 |

*Primary Examiner*—A. Michael Chambers

*Attorney, Agent, or Firm*—Oblon, Spivak, McClelland, Maier and Neustadt

[57] ABSTRACT

A hydraulic motor for driving a hydraulically driven fan system in a combustion engine includes both an oil pump and water pump in combination. The pump body and a pump cover together define a hollow chamber within which a shaft is rotatably mounted, the shaft supporting an oil pump rotor. A thrust plate in the hollow chamber coaxially aligns the pump body and pump cover and supports a first bearing for the shaft. The water pump is mounted in the pump cover and includes an impeller mounted on the shaft.

6 Claims, 4 Drawing Sheets

HYDRAULIC PUMP FOR HYDRAULICALLY DRIVEN FAN SYSTEM

BACKGROUND OF THE INVENTION

1. Field of the Invention

The present invention relates to a hydraulic motor for driving a hydraulically driven fan system that is for use with any kind of machine having an internal combustion engine.

2. Discussion of the Related Art

A vane pump is disclosed in Japanese Patent Laid-Open No. 271,982/1987. This known pump is now described with reference to FIG. 6. The pump has a housing 3 and a cam ring 1. One end of the ring 1 is closed off by a rear plate 2 which seals the housing 3 as a rear cover. The rear plate 2 is provided with a bearing hole 4 in which the protruding end 7 of a drive shaft 6 is inserted. The shaft 6 extends through a rotor 5. The protruding end 7 is held in the hole 4 via a bearing 8. The rear cover 2 is provided with a pair of knock holes which are arranged symmetrically with respect to the center of the hole 4 and remote from this center. Knock pins 9 are mounted in the knock holes with a press fit.

FIG. 7 shows an oil pump and a water pump which are simultaneously driven in a single-shaft multicylinder internal combustion engine as proposed in Japanese Patent Publication No. 42329/1985. A gear pump for lubricating oil has driven teeth 10. A coolant pump 11 has blades 12. The teeth 10 and the blades 12 are mounted on a common pump shaft 13, which is mounted inside a pump casing 14 and a casing 15. An oil seal 16 and a mechanical seal 17 are disposed between the pump teeth 10 and the pump blades 12.

For the vane pump shown in FIG. 6, the rear plate 2 is mounted coaxially with the housing 3 by use of the two knock pins 9. Therefore, it is difficult to mount the bearing 18 coaxially with the bearing 8. Also, it is difficult to achieve smooth rotation.

In the internal combustion engine shown in FIG. 7 the lubricating oil pump and the cooling water pump are driven simultaneously. The pump blades 12 are mounted to the pump shaft 13 with a press fit and so the mechanical seal 17 and the oil seal 16 cannot be detached. This presents problems in maintaining the engine.

SUMMARY OF THE INVENTION

It is an object of the present invention to provide a hydraulic pump which is free of the foregoing problems.

It is a more specific object of the invention to provide a hydraulic pump which is small in size, economical to fabricate, has a simple layout of belts, and in which a hydraulic pump for a fan and an engine-cooling water pump are driven on a single shaft.

The above, and other, objects are achieved according to the present invention by a hydraulic pump for a hydraulic driven fan system, comprising a pump body, a pump cover mounted to the pump body cooperating therewith to define a hollow chamber, a shaft rotatably mounted in the pump body and pump cover so as to extend through the hollow chamber, pump means on the shaft for pumping a fluid in the hollow chamber during rotation of the shaft, a thrust plate in the hollow chamber and fitting in both the pump body and the pump cover so as to coaxially align the pump body and the pump cover, a first bearing mounted in the thrust plate for rotatably supporting the shaft, a second bearing mounted in the pump body concentric with the first bearing for rotatably supporting the shaft, and a mechanical seal in the pump cover and coaxial with the shaft for mechanically sealing the shaft in the pump cover.

In one feature of the invention, the second bearing supporting the shaft, the hydraulic pump supporting the thrust plate, the first bearing on which the load of the water pump bears, and the water pump are arranged in this order. Pulley tension and the load of the hydraulic pump bear on the shaft.

In another feature of the invention, a water shaft impeller is screwed to the shaft.

When the pulley is rotated by the engine, the shaft is rotated to thereby rotate the rotor. Then, the volumes of the pump chambers partitioned by vanes change. Oil is drawn through the oil suction port and discharged through the oil discharge port. Rotation of the shaft turns the impeller of the water pump. As a result, water is drawn through the water suction port and discharged through the water discharge port by the centrifugal action of the pump.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
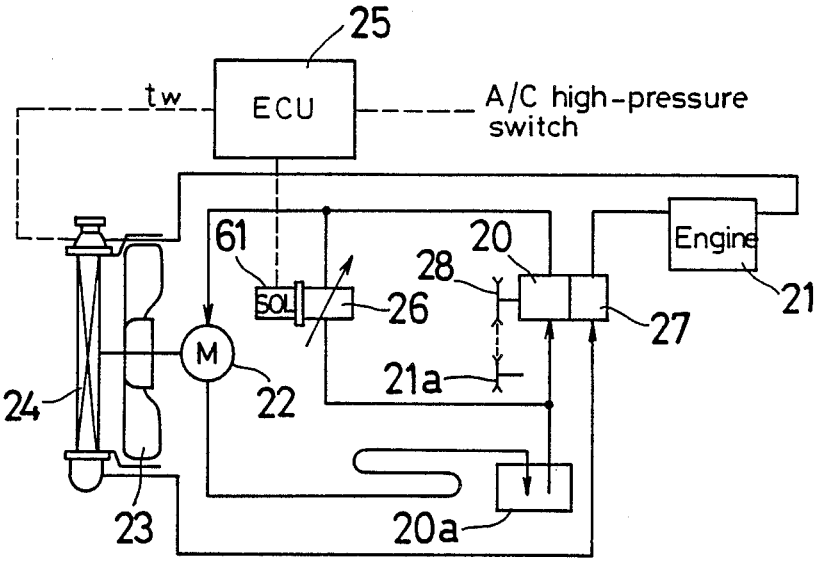
FIG. 1 is a block diagram of a hydraulically driven fan system including a hydraulic pump according to the invention.

Referring to FIG. 1, there is schematically shown a hydraulically driven fan system according to the invention. The system comprises a hydraulic pump 20, an engine 21, a hydraulic motor 22, a fan 23, a radiator 24, an electrical control unit (ECU) 25, a hydraulic control valve 26 in a bypass circuit, and a water pump 27. The hydraulic pump 20 is caused to pump oil from the reservoir tank **20*a* by the driving force produced by the engine 21, via the engine crank 21*a* and the pulley 28. The pressure is supplied to the hydraulic motor 22 to rotate the fan 23, for cooling the radiator 24. Thus, the engine 21 is cooled. The temperature of the water in the radiator 24 cooled by the fan 23** is detected by a water temperature sensor (not shown). The temperature output signal tω from the sensor is fed to the ECU 25, which controls the opening of a bypass between the pump outlet and inlet by the valve 26 as a function of input signal tω and a program stored in the ECU. In this way, the hydraulic pressure delivered from the pump 20 is controlled as is the rotational speed of the motor 22.

Figure 2:
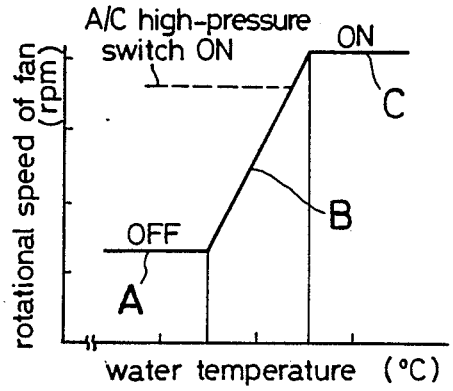
FIG. 2 is a diagram showing the relation of the rotational speed of the fan shown in FIG. 1 to the temperature of water.

The water pump 27 and the hydraulic pump 20 are mounted on a common shaft. The water pump 27 draws water from the radiator 24 and forces it to the engine 21 to cool the engine. The circuit of the water pump 27 consists of a well-known configuration. FIG. 2 shows a possible characteristic of the rotational speed of the fan 23 as set forth in the stored program.

Figure 3:
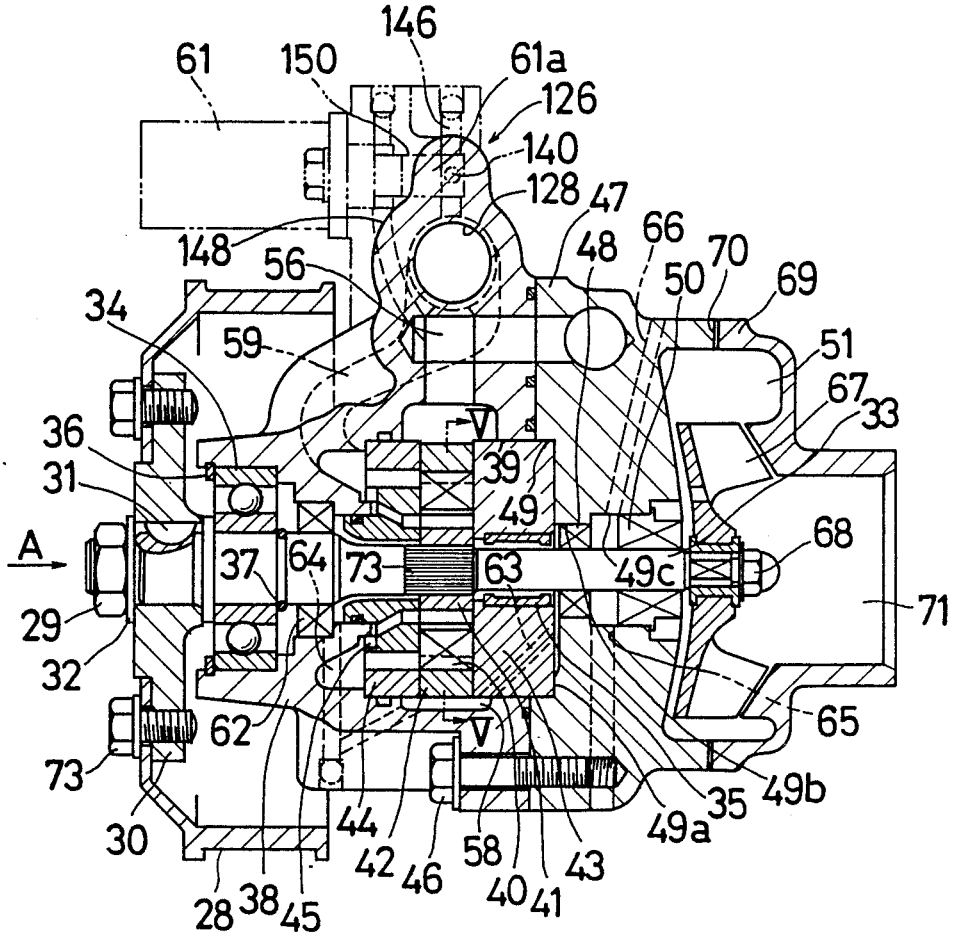
FIG. 3 is a side elevation in cross section of the hydraulic pump and the water pump in the system shown in FIG. 1.
Figure 4:
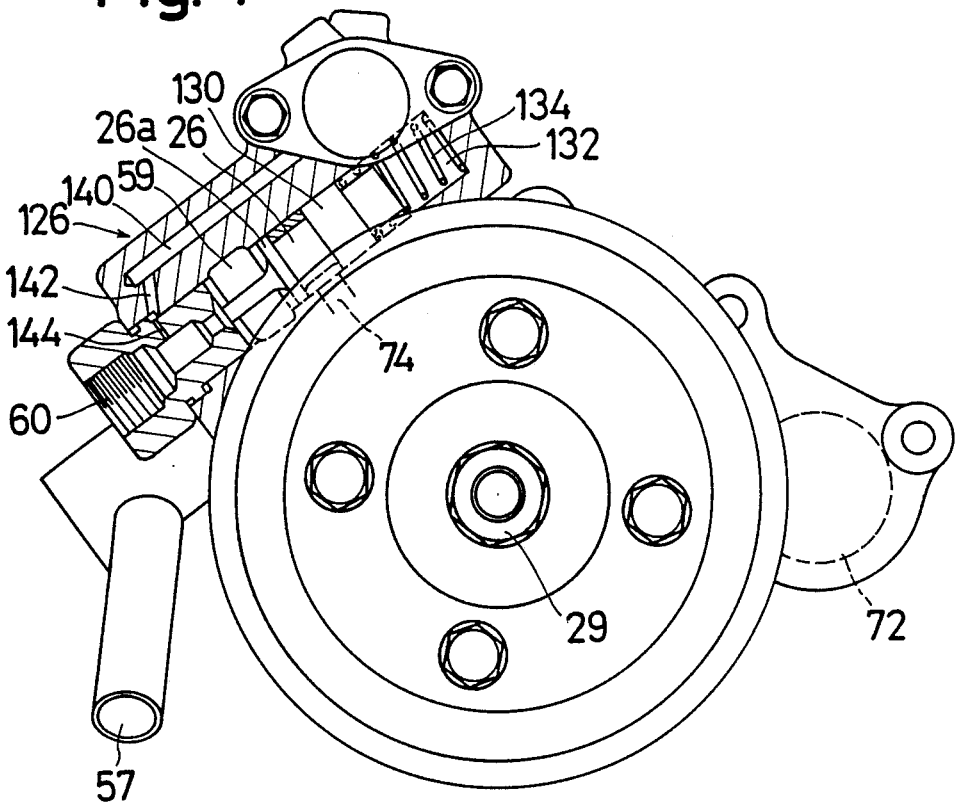
FIG. 4 is a partial cross section of the pump shown in FIG. 3, as viewed from the direction indicated by the arrow A.
Figure 5:
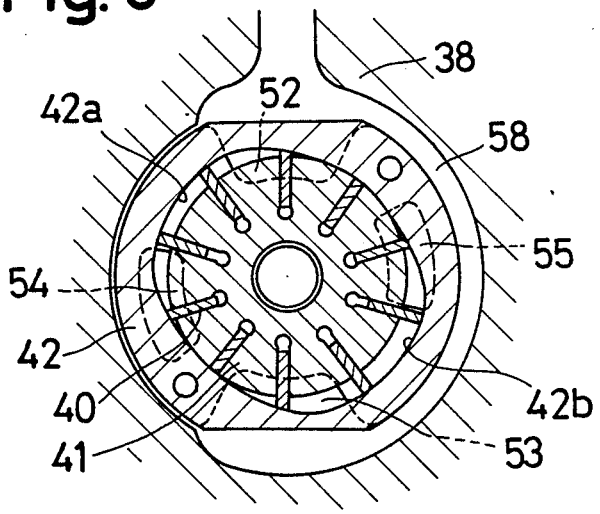
FIG. 5 is a cross-sectional view taken on line V—V of FIG. 3.

The hydraulic pump 20 and the water pump 27 are next described in detail by referring to FIGS. 3–5. The belt-driven pulley 28 is fixed to a pulley seat 30 by bolts 73. The pulley 28 and the pulley seat 30 may be fabricated integrally. The pulley seat 30 is connected to a shaft 33 by a key 31, the nut 29, and a washer 32. The shaft 33 is rotatably held by bearings 34 and 35, of which bearing 35 is a slide bearing. Snaps 36 and 37 are mounted at opposite ends of the bearing 34 to limit forward and rearward movement of the shaft 33 relative to a pump body 38 that is provided with a hollow chamber 39 having a bottom. The chamber 39 extends into one end of the pump body 38.

A rotor 41 is mounted in the hollow chamber 39, and a plurality of vanes 40 slidably held in radial slots of the rotor extend radially from the rotor 41. A cam ring 42, a thrust plate 43, a pressure plate 44, and a wave washer 45 are mounted in the chamber 39. The cam ring 42 has cam surfaces 42*a* and 42*b* which are formed in a diametrically symmetrical relation to each other. The front ends of the vanes 40 make sliding contact with the cam surfaces 42*a* and 42*b*. The thrust plate 43 and the pressure plate 44 are in tight contact with the opposite ends of the cam ring 42 to form a plurality of pump chambers which are partitioned by the vanes 40. The rotor 41, the cam ring 42, the thrust plate 43, and the pressure plate 44 are held in position by a pump cover 47 which is rigidly fixed to one end of the pump body 38 by means of clamping bolts 46. The wave washer 45 presses the rotor 41 against the thrust plate 43 to maintain the cam ring 42, the plates 43, 44, and the pump cover 47 in abutment with each other.

The pump cover 47 cooperates with the oil seal 48 to close the open outer end of the hollow chamber 39 inside the pump body 38, thus forming one side of the pump body. The pump cover is provided with a bore 49 having steps 49*a*, 49*b*, 49*c*. One end of the thrust plate 43 is inserted in the stepped hole 49*a* to hold the pump body 38 and the pump cover 47 in a coaxial relation to each other. The oil seal 48 and a mechanical seal 50 are inserted in the stepped holes 49*b* and 49*c*, respectively. The water pump 27 has a volute chamber 51 and a water discharge port 72. The other end of the pump cover 47 forms a part of the volute chamber 51 and a part of the water discharge port and functions as the body of the water pump. The aforementioned bearing 35 is inserted in the center of the thrust plate 43 in a concentric relation to the outer periphery of the shaft 33. Suction ports 52 and 53 are formed in the surfaces of the plates 43 and 44 which are in abutment with the rotor 40, at circumferential positions corresponding to the pump chamber in an expansion stroke. Exhaust ports 54 and 55 are also formed in these surfaces but at circumferential positions corresponding to the pump chamber in a compression stroke.

The suction ports 52 and 53 open into a groove 58 formed outside of the outer surface of the cam ring 42, the groove 58 being in communication with an oil duct 57 via an oil suction port 56. The discharge ports 54 and 55 are in communication with an oil discharge port 59 which connects to an oil discharge port 60. The discharge port 59 is also operatively connected with the oil suction port to form a bypass, via the pressure control valve 26 that is controlled by the solenoid 61.

Oil leaked from the discharge ports 54 and 55 lubricates the slide bearing 35. Oil return holes 63 and 64 are disposed at the oil side of oil seals 48 and 62, respectively, and in communication with the groove 58 formed at the outer surface of the cam ring 42, the groove 58 being in communication with the suction ports 52 and 53 to prevent high pressure from being applied to the oil seals 48 and 62. Water from the volute chamber which passes the mechanical seal 66 is drained through a drain hole 65. The mechanical seal 50, however, seals the drain hole 65 and another hole 66 communicating with the atmosphere from the volute chamber, to minimize water leakage. An impeller 67 is firmly fixed by a nut 68 to the end opposite the pulley 28 on the shaft 33. A water pump cover 69 is joined to the pump cover 47 via a gasket 70. Portions of a water suction port 71, the volute chamber 51, and a water discharge port 72 are formed in the cover 69. The rotor 41 engages a spline 73 mounted midway between the bearings 34 and 35 holding the shaft 33, and rotates with the shaft.

The pressure control valve 26 is positioned in a portion 126 of the pump body to which is mounted the solenoid 61. More specifically, the pressure control valve 26 has a land 26*a* which slides in a bore 128 of the portion 126 so as to selectively seal the discharge port 59 from the relief hole 74 which connects to the suction port 56.

Another land 130 of the pressure relief valve 26 closes a pressure chamber 132 within the bore 128. A spring 134 in the pressure chamber 132 normally biases the pressure control valve 126 to the left (as seen in FIG. 4), so as to isolate the relief hole 74 from the oil discharge port 59.

A pilot pressure bore 140 connects to the flow discharge port 60 via radial bores 142 and 144, and connects to the pressure chamber 132 via the radial bore 146. The bore 146 also connects to a return passage 148 via a solenoid shaft passage 150. The return bore 148 connects to the oil suction port 56, so that the pressure chamber 132 is normally at suction pressure, via the bores 146, 150 and passage 148.

A solenoid shaft 61*a* of the solenoid 61 slides in the solenoid shaft bore 150 and normally closes the pilot passage 140 while allowing communication between the bore 146 and passage 150. This can be done, for example, by providing a longitudinal groove in the solenoid shaft 61*a* which connects the bore 146 and passage 148 in the illustrated position. On the other hand, when the solenoid 61 is actuated, the solenoid shaft 61*a* is retracted so as to close communication between bore 146 and passage 148, while permitting the oil pressure in the pilot pressure bore 140 to enter the pressure chamber 132 via the bore 146.

During operation, when the engine temperature is low, the hydraulic motor 22 should revolve at low speed, which requires a reduced discharging oil volume from the hydraulic pump 20. At this time, the solenoid 61 is not actuated by the ECU 25, and the solenoid shaft 61*a* blocks communication between pilot pressure bore 140 and the pressure chamber 132, which permits the suction oil pressure from the oil suction port 56 to be applied to the pressure chamber 32 via the passage 148 and the bores 150 and 146. Due to the low suction pressure in the pressure chamber 132, the oil pressure of oil from the oil discharge port 59 causes the pressure control valve 26 to retract to the right from the position shown in FIG. 4, so that pumped oil is bypassed back to the oil suction port 56 via relief hole 74, thereby reducing the oil delivery to the hydraulic motor 22. This is shown in portion A of the fan speed curve in FIG. 2.

On the other hand, as the engine temperature rises and a greater rotation speed is required for the hydraulic motor 22, the solenoid 61 is actuated to retract the solenoid shaft 61*a*, thereby closing communication between bore 146 and passage 148, while permitting discharge oil pressure from the pilot pressure bore 140 to be applied to the pressure chamber 132. The increased pressure in chamber 132 forces the valve 126 to the left, i.e., to the position of FIG. 4, thereby blocking communication between the oil discharge port 59 and the relief hole 74. Accordingly, all of the pumped oil is discharged through the oil discharge port 60. Closure of relief hole 74 is shown at C in FIG. 2.

The ECU 25 preferably controls the solenoid 26 to gradually close relief hole 74 as a function of water temperature by gradually isolating bore 146 from passage 148, and this is shown at B in FIG. 2. As an option, the ECU can control the solenoid 61 such that the temperature at which the relief valve is closed can be changed when the A/C is switched on.

The rotation of the shaft 33 also rotates the impeller 67 of the water pump to draw water through the water suction port 71 by the action of the centrifugal pump. The water is discharged from the water discharge port 72.

Figure 6:
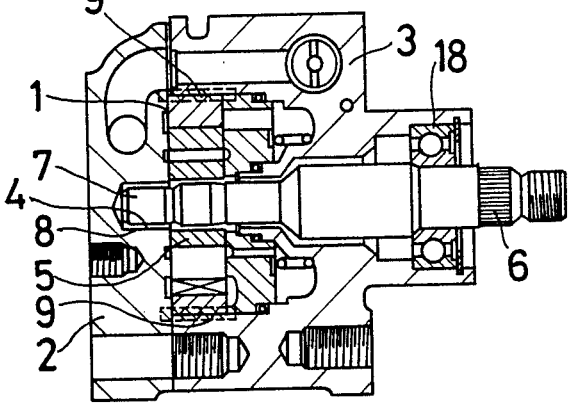
Fig. 6 (PRIOR ART)
FIG. 6 is a side elevation in cross section of a known vane pump.
Figure 7:
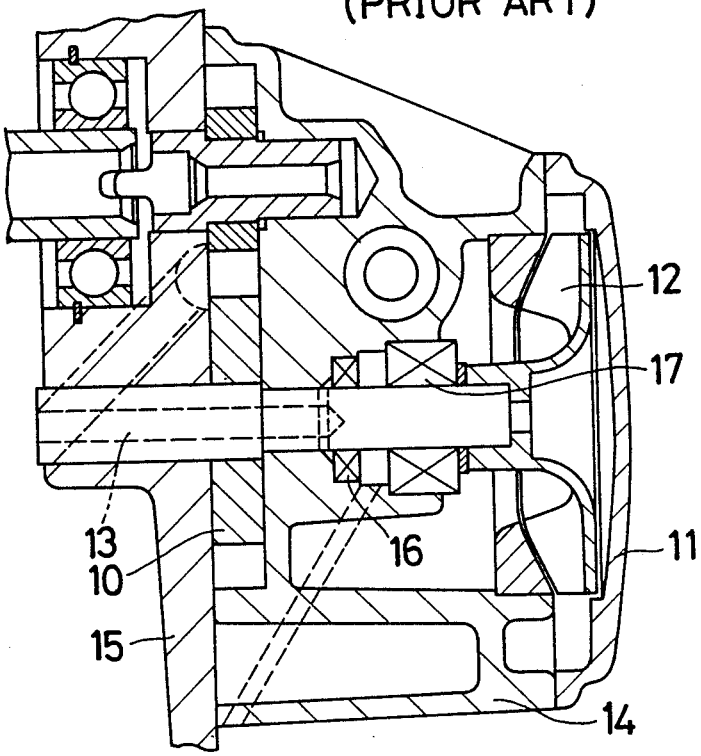
Fig. 7 (PRIOR ART)
FIG. 7 is a side elevation in cross section of a known single-shaft pump for a multicylinder internal combustion engine.

Since the novel fan system is constructed as described thus far, it does not require knock pins, which would have been heretofore necessary to smoothen rotation of bearings. That is, the left surface of the edge portion of the cam ring 1 in FIG. 6 is the same surface as the left surface of the edge portion of the housing. Therefore, the rear cover 2 is provided with the knock holes 9 which are arranged symmetrically with respect to the center of the hole 4 and remote from this center. On the other hand, the right surface of the edge portion of the thrust plate 43 in the present invention is not aligned with the right surface of the edge portion of the pump body 38. Consequently, the thrust plate 43 substitutes for knock pins, which are not necessary, by centering the pump body and pump cover.

Because all the axial holes can be machined coaxially, the machining accuracy can be enhanced. Further, the system can be fabricated economically and in small size. Additionally, the hydraulic pump and the water pump use the common bearing 35, thus reducing the number of bearings by one, as compared with the prior art system. Also, only one shaft is necessitated. Furthermore, the impeller, the mechanical seal, and other parts which are required to be maintained can be quite easily detached. In this way, the novel system yields various advantages.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A hydraulic pump for a hydraulically driven fan system, comprising:

a pump body;

a pump cover mounted to said pump body and cooperating therewith to define a hollow chamber;

a shaft rotatably mounted in said pump body and pump cover so as to extend through said hollow chamber;

pump means on said shaft for pumping a fluid in said hollow chamber during rotation of said shaft;

a thrust plate in said hollow chamber, said thrust plate fitting in both said pump body and said pump cover so as to coaxially align said pump body and said pump cover;

a first bearing mounted in said thrust plate for rotatably supporting said shaft;

a second bearing mounted in said pump body concentric with said first bearing for rotatably supporting said shaft; and a mechanical seal in said pump cover and coaxial with said shaft for mechanically sealing said shaft in said pump cover.

2. The hydraulic pump of claim 1 including oil inlet and outlet means in said pump body and connected to said first pump means, whereby said hydraulic pump is an oil pump.

3. The hydraulic pump of claim 2 including a water pump in combination with said hydraulic pump, said water pump comprising a volute chamber in said pump cover and a water pump impeller mounted to said shaft in said volute chamber, wherein said first bearing is also a bearing for said water pump impeller and wherein said volute chamber is isolated from said hollow chamber by said mechanical seal.

4. The hydraulic pump of claim 3 including shaft drive means connected to said shaft adjacent said second bearing.

5. The hydraulic pump of claim 2 including oil bypass means for bypassing pumped oil back to said oil inlet.

6. The hydraulic pump of claim 5 including a solenoid actuated valve for opening said bypass means.

* * * * *